US008429856B1

(12) United States Patent
McCabe et al.

(10) Patent No.: US 8,429,856 B1
(45) Date of Patent: Apr. 30, 2013

(54) DOUBLE-HUNG WINDOW WITH UNIFORM WOOD INTERIOR

(75) Inventors: Jerome J. McCabe, Wausau, WI (US); Jeffrey A. DeLonay, Wausau, WI (US); George H. Digman, Weston, WI (US)

(73) Assignee: Kolbe & Kolbe Millwork Co., Inc., Wausau, WI (US)

( * ) Notice: Subject to any disclaimer, the term of this patent is extended or adjusted under 35 U.S.C. 154(b) by 0 days.

(21) Appl. No.: 13/486,447

(22) Filed: Jun. 1, 2012

Related U.S. Application Data

(60) Division of application No. 12/546,163, filed on Aug. 24, 2009, now Pat. No. 8,196,355, which is a continuation of application No. 11/756,136, filed on May 31, 2007, now abandoned, which is a division of application No. 10/760,109, filed on Jan. 16, 2004, now Pat. No. 7,296, 381.

(60) Provisional application No. 60/526,146, filed on Dec. 1, 2003.

(51) Int. Cl.
*E06B 3/00* (2006.01)

(52) U.S. Cl.
USPC ..... 49/506

(58) Field of Classification Search ..... 49/414, 49/415, 422, 423, 424, 428, 454, 183, 176, 49/184, 185, 506
See application file for complete search history.

(56) References Cited

U.S. PATENT DOCUMENTS

| | | | |
|---|---|---|---|
| 926,735 | A | 7/1909 | Gould |
| 2,593,239 | A | 4/1952 | Anderson |
| 3,145,433 | A | 8/1964 | Jones |
| 4,034,510 | A | 7/1977 | Huelsekopf |
| 4,158,934 | A | 6/1979 | Olsen |
| 4,569,154 | A | 2/1986 | Bayer |
| 4,726,148 | A | 2/1988 | Tix |
| 4,924,084 | A | 5/1990 | Lask et al. |
| 4,942,084 | A | 7/1990 | Prince |
| 5,125,442 | A | 6/1992 | Hendrickson |
| 5,265,308 | A | 11/1993 | May et al. |
| 5,274,955 | A | 1/1994 | Dallaire et al. |
| 5,446,997 | A | 9/1995 | Simonton |
| 5,448,869 | A | 9/1995 | Unruh et al. |

(Continued)

OTHER PUBLICATIONS

"Optimism Reigns at Builders' Show", WindowandDoor.net, pp. 1-4, Mar. 2002.

(Continued)

*Primary Examiner* — Jerry Redman
(74) *Attorney, Agent, or Firm* — James L. Young; Westman, Champlin & Kelly, P.A.

(57) ABSTRACT

A double-hung window having a uniform interior wood appearance is disclosed. The window has a head jamb and side jambs. The window has an upper and lower sash, each having a wood frame. The upper and lower sashes are held in the window by the side jambs. Lock-pins are extendable from each side of the lower sash. A concealed jamb liner cover for selective engagement with each upper side jamb is provided which has an exposed wood surface and a channel for receiving the lock-pin of the lower sash. An upper sash lock housing attached to an upper portion of the wood frame of the upper sash, is provided which holds an upper sash lock-pin for each side of the upper sash. A wooden interior upper parting stop connected to the head jamb conceals the upper sash lock housing when the window is closed.

4 Claims, 10 Drawing Sheets

U.S. PATENT DOCUMENTS

| | | | | |
|---|---|---|---|---|
| 5,544,450 | A | 8/1996 | Schmidt et al. | |
| 5,560,154 | A | 10/1996 | Matarazzo | |
| 5,566,507 | A | 10/1996 | Schmidt et al. | |
| 5,619,828 | A | 4/1997 | Ver Meer | |
| 5,671,566 | A | 9/1997 | Tix et al. | |
| 5,675,937 | A | 10/1997 | Stebel | |
| 5,855,092 | A | 1/1999 | Raap et al. | |
| 6,026,617 | A | 2/2000 | Stark | |
| 6,122,864 | A | 9/2000 | Martin | |
| 6,305,126 | B1 | 10/2001 | Hendrickson et al. | |
| 6,341,449 | B1 | 1/2002 | Stahl | |
| 6,530,190 | B2 | 3/2003 | Conachen | |
| 6,588,150 | B1 | 7/2003 | Wong et al. | |
| 6,684,571 | B2 | 2/2004 | Hendrickson et al. | |
| 6,722,082 | B1 | 4/2004 | Peterson et al. | |
| 6,883,276 | B1 | 4/2005 | Hannan et al. | |
| 7,296,381 | B1 * | 11/2007 | McCabe et al. | 49/454 |
| 7,448,164 | B1 * | 11/2008 | McCabe | 49/185 |
| 7,552,562 | B2 * | 6/2009 | Curtis et al. | 49/414 |
| 2002/0023387 | A1 | 2/2002 | Hendrickson et al. | |
| 2004/0139659 | A1 * | 7/2004 | Hendrickson et al. | 49/428 |
| 2005/0066581 | A1 | 3/2005 | Rhode et al. | |
| 2006/0254151 | A1 * | 11/2006 | Curtis et al. | 49/414 |

OTHER PUBLICATIONS

Product Brochure, "Renovations 6500", Home Depot, pp. 1-4, 2002.

* cited by examiner

DOUBLE-HUNG WINDOW WITH UNIFORM WOOD INTERIOR

CROSS-REFERENCE TO RELATED APPLICATION(S)

The present application is a divisional of and claims priority to U.S. patent application Ser. No. 12/546,163, filed Aug. 24, 2009 which is a continuation of and claims priority to U.S. patent application Ser. No. 11/756,136, filed May 31, 2007, which is a divisional of and claims priority to U.S. patent application Ser. No. 10/760,109, filed Jan. 16, 2004, issued as U.S. Pat. No. 7,296,381, and which is based upon and claims priority to provisional application 60/526,146, filed on Dec. 1, 2003, the contents of each are hereby incorporated by reference in their entireties.

BACKGROUND

This invention relates to improvements in the design of a window, and in particular to improvements in the design of a double-hung window to provide a uniform wood interior appearance to the double-hung window.

Traditionally, windows were constructed of wood because wood was readily available for construction. Wood windows are desirable in some applications for their aesthetic appearance. The exposed interior wood can be stained to expose the natural look of the grain of the wood or the interior wood can be painted repeatedly to match the interior of the building or home.

Constructing a window from wood is costly. First, the wood material is expensive. Second, because wood is a naturally occurring material with each piece having a unique structure, some of the wood has natural defects inherent with its structure making it unusable for construction. Additionally, during the manufacturing process the wood can be damaged rendering a piece unusable for construction, thereby increasing waste and costs.

Developments in material science have produced materials like plastic, vinyl, and wood composite materials, which have desirable properties for use in constructing windows. Therefore, although many portions of a window may still be made of wood, like the frame of the sash, there are other portion of the window that are more easily and inexpensively constructed of materials other than wood. Plastics, vinyl, and wood composite materials are desirable because of durability, low cost, and consistency during manufacture, fabrication, and installation. Materials other than wood can give the window better performance by improving window mechanics (i.e., movement) and increasing the structural integrity of the window.

The side jambs, which contain the extension slots and balance tubes for raising and lowering the sashes, and the housing for the sash locks, are more easily constructed from a vinyl extruded material than from wood. However, when the window is closed, this vinyl extruded material is exposed on the interior portion of the window and diminishes the traditional all-wood appearance of the window. Generally, materials like plastics, vinyl, and wood composites cannot be as effectively painted or cannot have their color as easily changed as wood.

It would be desirable to construct some parts of the window from materials other than wood to obtain the advantages that plastic, vinyl, and wood composite materials produce, while constructing the parts of the window exposed to the interior of the building or home from wood to achieve an aesthetically pleasing window. Therefore, there is a need for a side jamb liner cover, which covers the vinyl exposed at the side jamb of the window and gives the window a uniform all-wood appearance. In particular, there is a need for an upper jamb liner cover that gives the interior of the double-hung window a uniform and traditional wood appearance while the window is in the closed position but still allows for slidable movement of the lower sash of the window.

Weatherstripping is often provided in a window to improve the energy efficiency of the window. The top rail of the upper sash often lacks weatherstrip because the weather strip would be exposed to the interior, thereby diminishing the wood interior appearance of the window. Placing the weatherstrip directly into the sash presents expensive and cumbersome assembly concerns. Providing alternative, non-wood, structures for holding the weatherstrip improves the ease of manufacturing but does not allow for a uniform wood interior appearance of the window. A locking mechanism is provided at the top rail of the upper sash to hold the upper sash in the window frame but still allows for disengagement in order to tilt the upper sash towards the interior of the building or home for maintenance and cleaning. Often this locking mechanism, normally constructed of a non-wood material, is exposed to the interior of the window, thereby diminishing the wood interior appearance of the window. Therefore, there is a need for a top rail weatherstrip and lock bolder, which contains a sash locking mechanism and weatherstripping, but still provides a uniform wood interior appearance while the window is closed.

SUMMARY

A first aspect of the present disclosure is directed to a window assembly that includes a window frame having a first side jamb and a second side jamb, where the first side jamb includes an extension slot and a lock pin slot. The window assembly also includes a sash slidably retained by the first side jamb and the second side jamb of the window frame, where the sash includes a lock pin that is extendable into the lock pin slot of the first side jamb. The window assembly further includes a jamb liner cover that includes a first portion configured to cover at least a portion of the extension slot of the first side jamb, the first portion having a back side and a substantially flat front side, an attachment mechanism extending from the back side of the first portion, and being configured to secure the jamb liner cover to the first side jamb at the extension slot, and a channel portion configured to extend within the lock pin slot of the first side jamb, and further configured to receive the lock pin of the sash in a manner that allows slidable movement of the sash.

Another aspect of the present disclosure is directed to a window assembly that includes a window frame having a first side jamb and a second side jamb, where the first side jamb includes an extension slot and a lock pin slot, a first sash slidably retained by the first side jamb and the second side jamb of the window frame, and a second sash slidably retained by the first side jamb and the second side jamb of the window frame, where the second sash includes a lock pin that is extendable into the lock pin slot of the first side jamb. The window assembly also includes a jamb liner cover securable to the extension slot of the first side jamb, where the jamb liner cover includes a first portion configured to cover the extension slot, a channel portion configured to extend within the lock pin slot of the first side jamb, and further configured to receive the lock pin of the second sash in a manner that allows slidable movement of the second sash, and a wood veneer layer disposed on the first portion and the channel portion.

Another aspect of the present disclosure is directed to a method of installing a jamb liner cover to a window frame of a window assembly, where the window frame has a first side jamb and a second side jamb. The method includes aligning a jamb liner cover adjacent to an extension slot and a lock pin slot of the first side jamb, where the jamb liner cover comprises a first portion having a back side and a substantially flat front side, a channel portion, and an attachment mechanism extending from the back side of the first portion. The method also includes inserting the channel portion of the jamb liner cover into the lock pin slot of the first side jamb, and engaging the attachment mechanism of the jamb liner cover with the extension slot of the first side jamb to secure to the jamb liner cover to the first side jamb in a manner that covers at least a portion of the extension slot and the lock pin slot.

While the above-identified drawings and figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principals of this invention. The figures may not be drawn to scale. Like reference numbers have been used throughout the figures to denote like parts.

DETAILED DESCRIPTION

Figure 1:
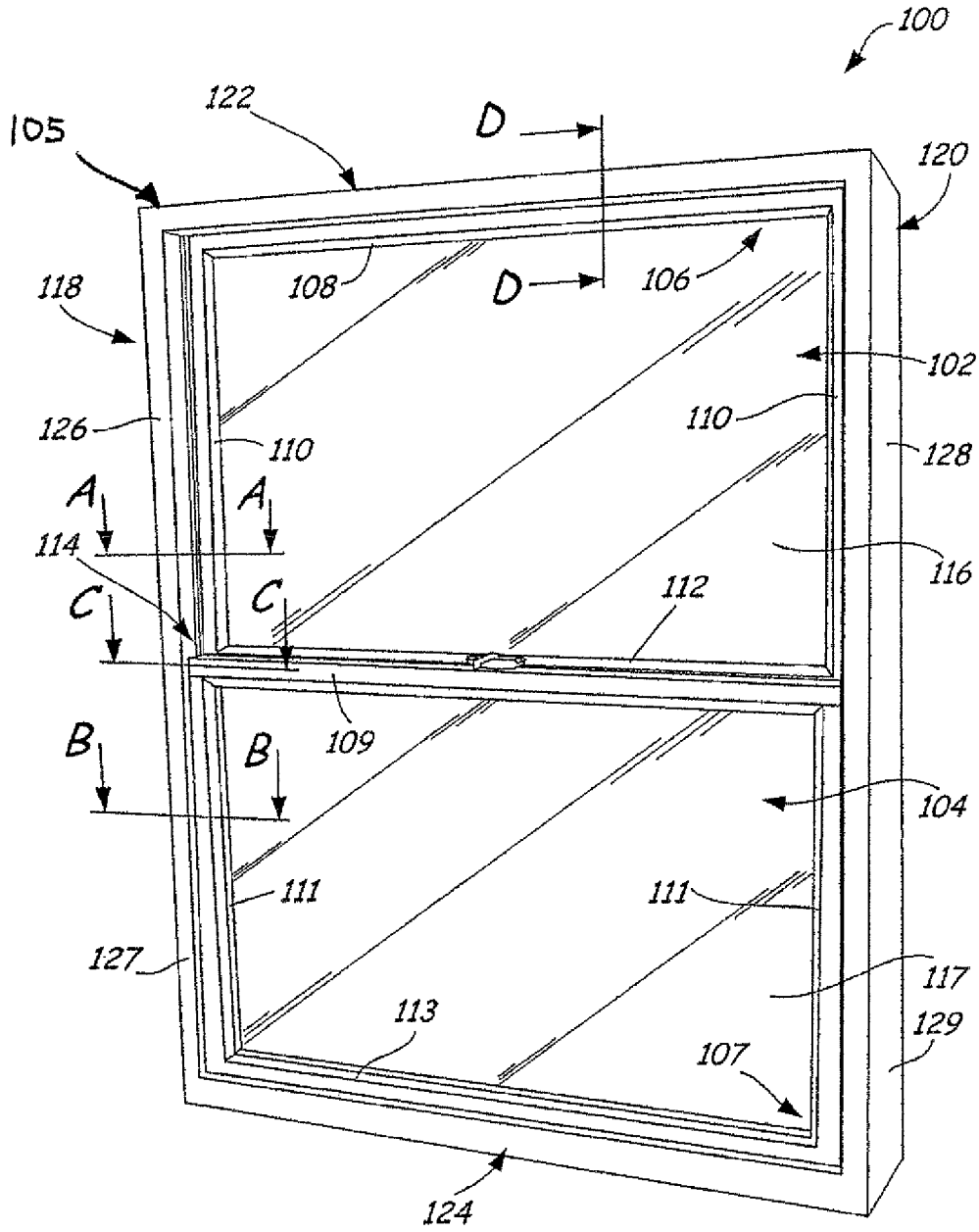
FIG. 1 is a perspective view of a double-hung window in a closed position, as viewed from the interior.

FIG. 1 is a perspective view of a double-hung window 100 in a closed position as viewed from the interior of a home or building. The double-hung window 100 has an upper sash 102 and a lower sash 104. Surrounding the upper sash is a frame 106 comprising a top rail 108, side rails 110, and bottom rail 112 that hold the upper sash glass 116 in place. Surrounding the lower sash is a frame 107 comprising a top rail 109, side rails 111, and bottom rail 113 that hold the lower sash glass 117 in place. The frame 106, 107 can be constructed of any known window building material. To provide a wood window, the frame 106, 107 should be constructed of wood. When the double-hung window 100 is in the closed position as shown in FIG. 1, upper sash 102 and lower sash 104 meet at a check rail 114.

Surrounding the upper sash 102 and lower sash 104 and securing the upper sash 102 and lower sash 104 within the double-hung window 100 is a window frame 105 having a first side jamb 118, second side jamb 120, head jamb 122, and sill 124. The first side jamb 118 has an upper portion 126 and a lower portion 127. The second side jamb 120 has an upper portion 128 and a lower portion 129. When the window is closed, the top rail 108 of the upper sash 102 sealably contacts the head jamb 122. In the closed position, the bottom rail 113 of the lower sash 104 sealably contacts the sill 124. In the closed position, there are no openings from the interior to the exterior of the double-hung window 100. When the double-hung window 100 is in the closed position, a portion of the upper first side jamb 126 and upper second side jamb 128 is visible from the interior of the window 100.

Figure 5:
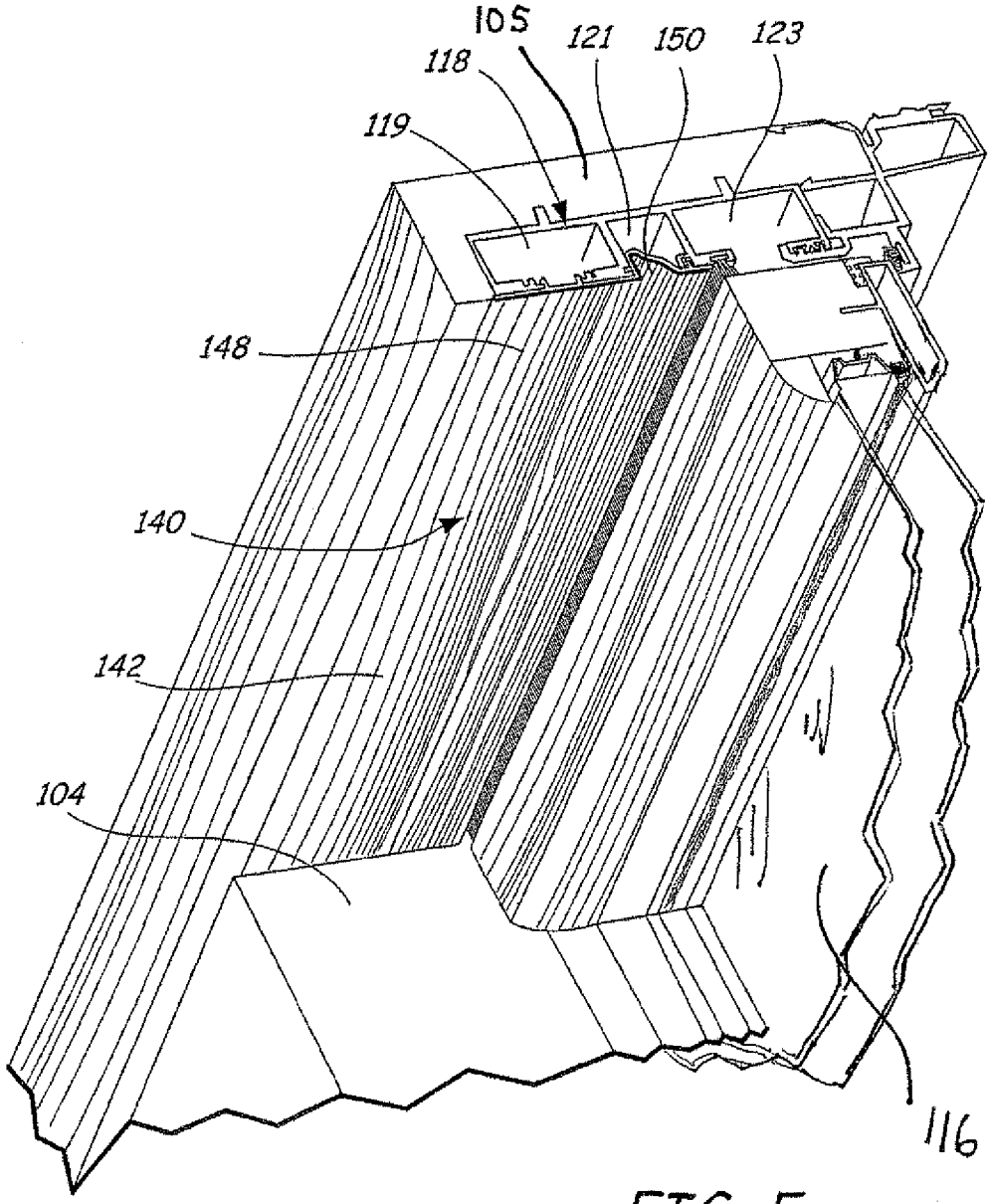
FIG. 5 is a perspective sectional view of an upper side jamb having a concealed jamb liner cover, as taken along lines A-A in FIG. 1.

The upper sash 102 and lower sash 104 each slide vertically and independently along the first side jamb 118 and the second side jamb 120. The first and second side jambs comprise slots for receiving the respective upper and lower sashes. As shown in FIG. 5, the side jamb has an interior extension slot 119, an exterior extension slot 123 and a lock pin slot 121. The slots allow the sashes to vertically slide along the side jambs. These slots are not typically constructed of wood, so when the window is closed, the non-wood interior extension slot 119 and lock pin slot 121 (if not otherwise covered) would be exposed to the interior.

Figure 2:
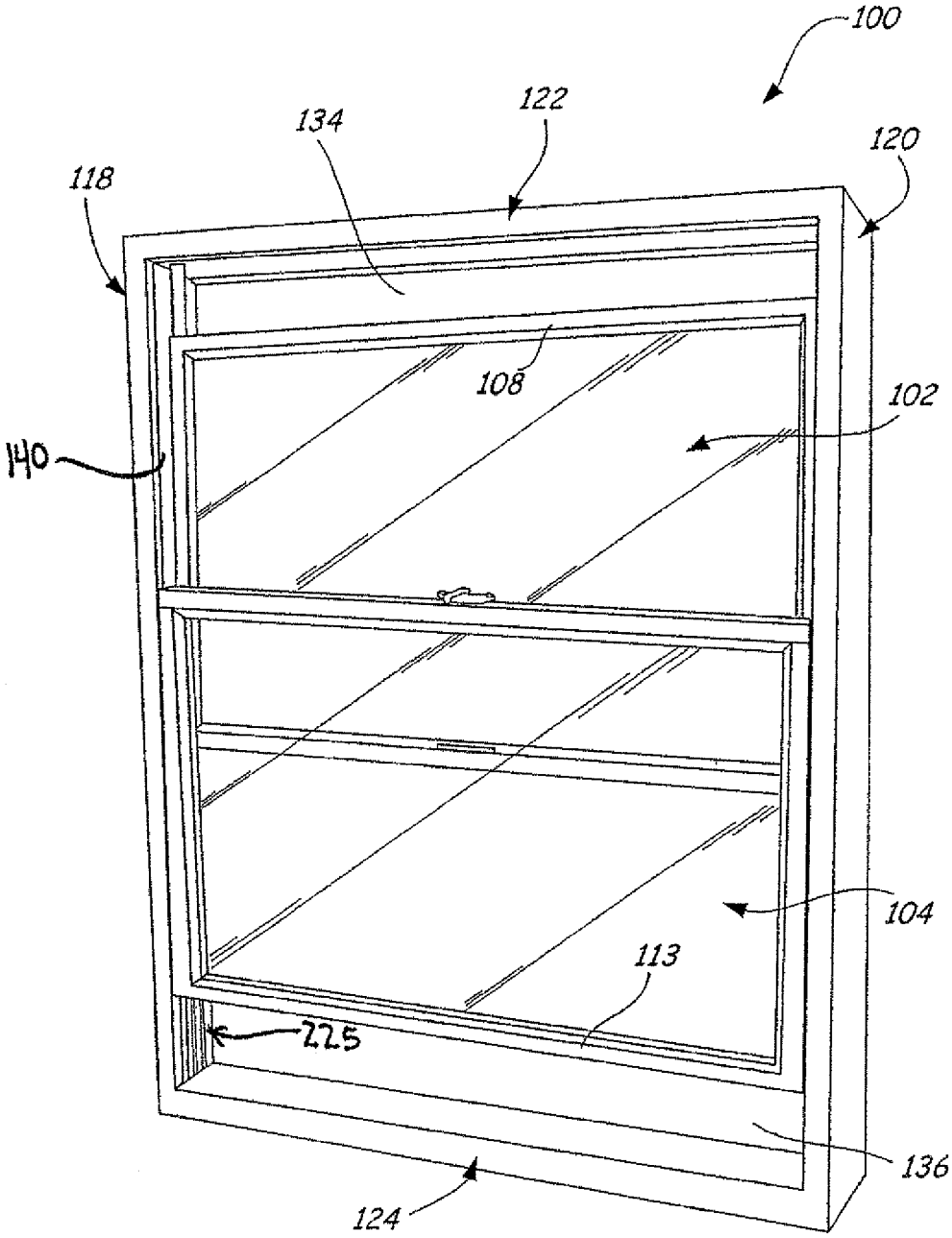
FIG. 2 is a perspective view of a double-hung window in an open position, as viewed from the interior.

FIG. 2 is a perspective view of the double-hung window 100 in one of several possible open positions. In these open positions, there is either an upper gap 134 between the top rail 108 of the upper sash 102 and the head jamb 122 or a lower gap 136 between the bottom rail 113 of the lower sash 104 and the sill 124. As shown in FIG. 2, there can be both an upper gap 134 and a lower gap 136.

To conceal the side jambs, each of the upper side jambs have been covered with a concealed jamb liner cover 140 (See FIGS. 2 and 5-9) to give the interior of the double-hung window 100 a uniform wood appearance. Additionally, the lower side jambs, at the exterior of the window can be covered with an exterior jamb liner cover 225 (See FIGS. 2 and 7) to give the exterior of the double-hung window 100 a uniform appearance.

Figure 3:
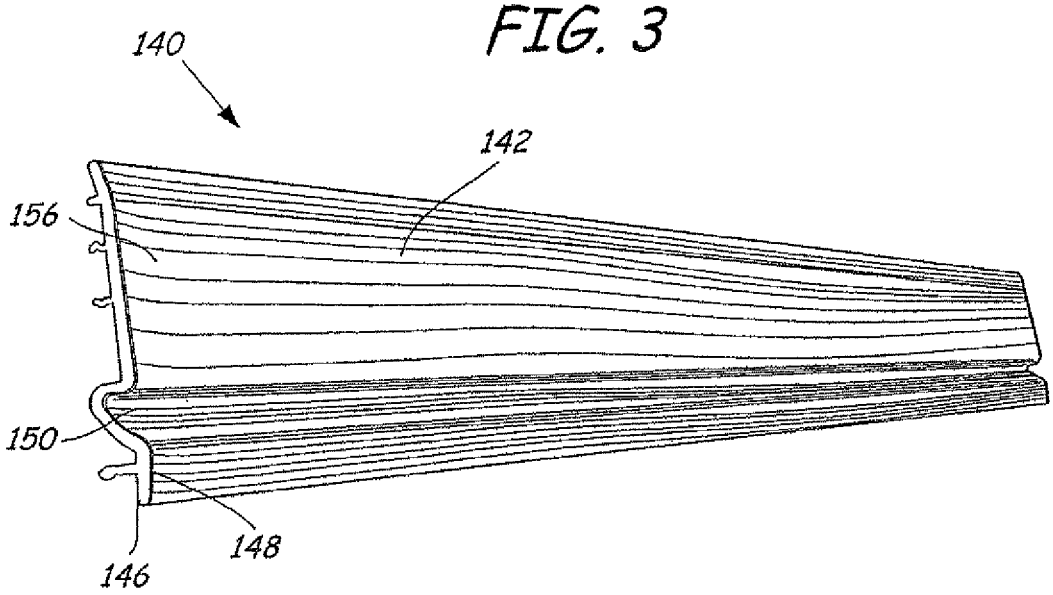
FIG. 3 is a perspective view of an exposed side of a concealed jamb liner cover.

FIG. 3 is a perspective view of a front exterior side 142 of the concealed jamb liner cover 140. The concealed jamb liner cover 140 covers the interior extension slot 119 and lock pin slot 121, so a front side 142 of the concealed jamb liner cover is exposed as the upper first side jamb 126 and upper second side jamb 128 of the double-hung window 100. The concealed jamb liner cover 140 has a contoured profile 146 of extruded plastic (e.g., vinyl) with a wood veneer 148 overlying the contoured profile 146. The front side 142 of each concealed jamb liner cover 140 has a lock channel 150 and a flat portion 156 for engaging the respective side rail 111 of the lower sash 104. The lock channel 150 and flat portion 156 extend over the entire length of the concealed jamb liner cover 140.

In constructing the concealed jamb liner cover 140, the contoured profile 146 is extruded, and then an overlayer of wood veneer 148 is adhered to the contoured profile 146. In one embodiment, a polyurethane reactive (PUR) hotmelt glue system is used to laminate the wood veneer 148 to the contoured profile 146.

Figure 4:
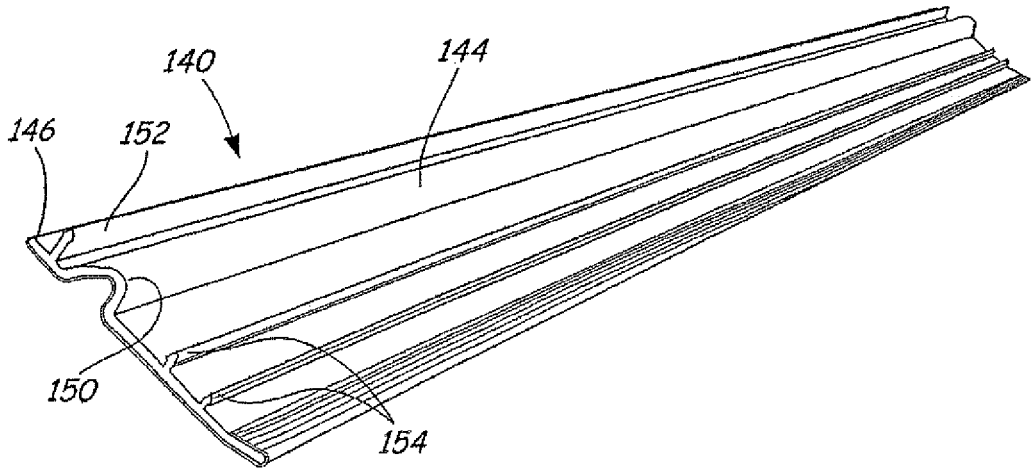
FIG. 4 is a perspective view of an interior side of a concealed jamb liner cover.

FIG. 4 is a perspective view of a back interior side 144 of the concealed jamb liner cover 140. Each concealed jamb liner cover 140 has a back side 144, which faces its respective upper first side jamb 126 or upper second side jamb 128 of the double-hung window 100. Extending from the back side 144 is interlock flange 152, lock channel 150, and snap-fit flanges 154, all of which, in one embodiment, extend over the entire length of the back side 144 of the concealed jamb liner cover 140. The interlock flange 152 and snap-fit flanges 154 allow for the concealed jamb liner cover 140 to be attached to the respective side jamb of the window. The lock channel 150 has an indentation for receiving the lock pins 158 of the lower sash 104.

FIG. 5 is a perspective sectional view taken along line A-A of FIG. 1 of the upper first side jamb 118 having a concealed jamb liner cover 140. The lower sash 104 is in the closed position so that the front side 142 of the concealed jamb liner cover 140 is exposed to the interior of the double-hung window 100. To attach the concealed jamb liner cover 140 to the upper side jambs (See FIG. 6), the interlock flange 152 engages with receiving opening 153 and the snap-fit flanges 154 interconnect with the interior extension slot 119 to hold the concealed jamb liner cover 140 to the side jamb. The lock channel 150 is received in the lock slot 121. Other types of attachment mechanisms are within the scope of this invention to allow the concealed jamb liner cover 140 to be secured to the upper first side jamb 126 and upper second side jamb 128. The concealed jamb liner cover 140 can be removable or permanently attached to the side jamb.

As can be seen in FIG. 5, with the concealed jamb liner cover 140 in place, the interior extension slot 119 and lock slot 121, which may be constructed of plastic, vinyl, wood composite, or metal, are covered while the lower sash 104 is in the closed position (FIG. 1). As can be seen, the wood veneer 148 gives the appearance of an entire wood finish, and the concealed jamb liner cover 140 conceals plastic, vinyl and/or metal portions of the upper first side jamb 118 when the window is in the closed position. This wood veneer 148 surface can be stained or finished to give a natural wood appearance to the interior of the window or can be painted repeatedly.

Figure 6:
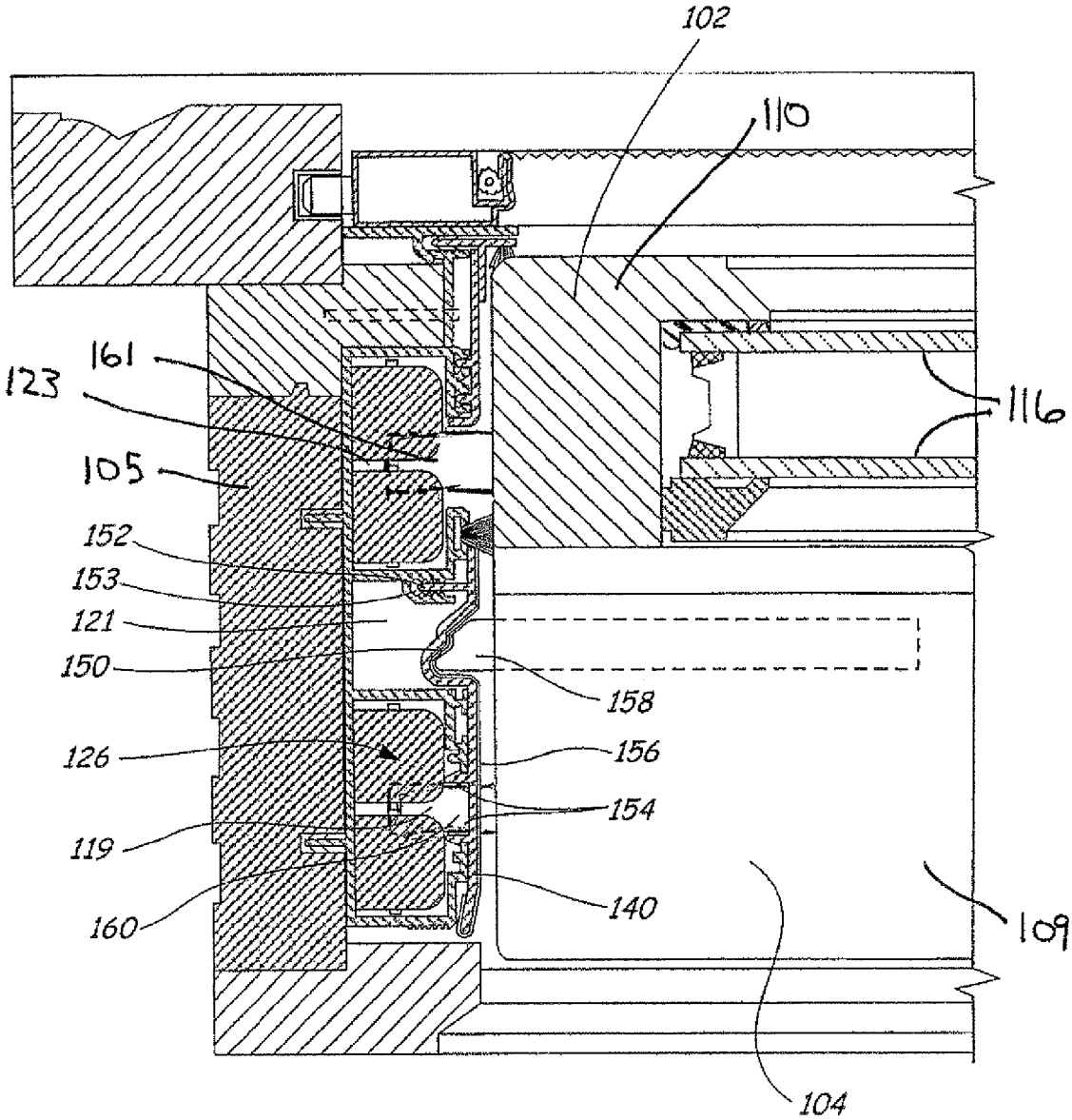
FIG. 6 is a sectional view through an upper sash of a double-hung window showing a concealed jamb liner cover, as taken along lines A-A in FIG. 1.

FIG. 6 is a sectional view though the upper sash 102 of the double-hung window 100 along line A-A as shown in FIG. 1 showing the concealed jamb liner cover 140. The upper sash 102 has a pivot pin 161, shown schematically to allow the upper sash to be released towards the interior. The upper sash pivot pin 161 travels in the exterior extension slot 123. In this view, the lower sash 104 is in the closed position and is below the plane of the sectional view. FIG. 6 shows the concealed jamb liner cover 140 engaged with the upper first side jamb 126 to conceal the interior extension slot 119 and lock slot 121. It is understood that there is also a concealed jamb liner cover 140 positioned at the upper second side jamb 128, which would be a minor image of FIG. 6. The concealed jamb liner cover 140 can be removable from the side jamb. The interlock flange 152 engages with receiving opening 153 and snap-fit flanges 154 lock with the interior extension slot 119 to hold the concealed jamb liner cover to the upper first side jamb 126.

Lower sash 104 has a lock pin 158 positioned to extend outwardly (to the side) from each end of the top rail 109 of the lower sash 104. Each lock pin 158 slidably engages with lock channel 150 of its respective concealed jamb liner cover 140 to hold the lower sash 104 in the double-hung window 100 during opening and closing of the lower sash 104. Because the lock channel 150 extends the entire length of each concealed jamb liner cover 140, the lower sash 104 can travel vertically along the opposed concealed jamb liner covers 140 with the lock pins 158 sliding in the lock channels 150. The flat portions 156 of the concealed jamb liner covers 140 allow for the side rails 111 of the lower sash 104 to slide vertically.

Each concealed jamb liner cover 140 extends from the top of the upper first side jamb 126 or the top of the upper second side jamb 128 to just below the top of the lower sash 104 when the window is in the closed position. Thus, the front side 142 of the concealed jamb liner cover 140 is entirely exposed to the interior of the window 100 while the lower sash 104 is in the closed position. The front side 142 of the concealed jamb liner cover 140 contains the wood veneer 148 surface so that the interior of the window has a uniform wood appearance while the window 100 is in the closed position.

It is understood that although the description was with respect to the upper first side jamb 126, a similar design is applied to the upper second side jamb 128. The design for the upper second side jamb 128 would be a mirror image of the description with respect to the upper first side jamb 126.

Figure 7:
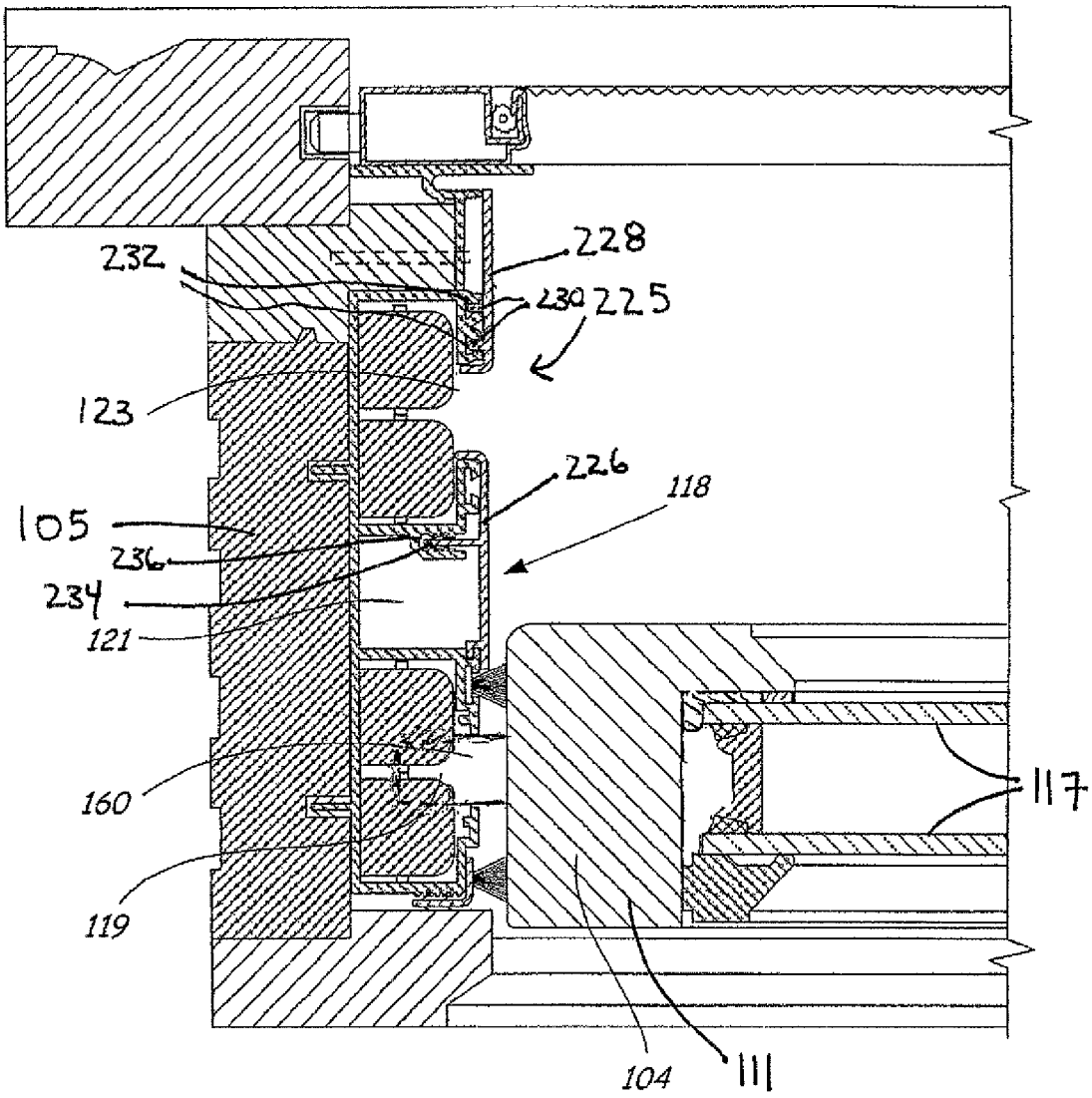
FIG. 7 is a sectional view through the lower sash of a double-hung window showing the pivot pin channel, as taken along lines B-B in FIG. 1.

FIG. 7 is a sectional view through a lower sash 104 taken along line B-B of FIG. 1. Although FIG. 7 only shows the first side jamb 118, it is understood that there is a mirror image of the design in FIG. 7 at the second side jamb 120. Attached and laterally projecting from the bottom rail 112 of the lower sash 104 is a pivot pin 160, shown schematically. Pivot pins are known in the art. The pivot pin 160 travels in the interior extension slot 119 of the first side jamb 118 and second side jamb 120. The lock pin 158 on the lower sash 104 is selectively retractable so that the pivot pin 160 will allow for tilting of the double-hung window about its pivot pins 160. Because the pivot pin 160 is located at the bottom rail 112 of the lower sash 104, there is no need to have an indented pivot pin channel 162 in the jamb liner cover 140.

In addition to a concealed jamb liner cover 140 to cover the upper interior side jamb, an exterior jamb liner cover 225 can also be provided to cover the lower exterior side jamb (i.e., the exposed portion of the side jamb on the outside of the window 100 below the upper sash 102 when the upper sash 102 in fully closed as seen in FIG. 1). FIG. 7 shows the exterior jamb liner cover 225 engaged with the first side jamb 118. It is understood that an exterior jamb liner cover 225 would also be provided on the second side jamb 120 having a design that is a mirror image of that shown in FIG. 7. The exterior jamb liner cover 225 has as inner cover 226 to cover the lock channel 121 and an inner portion of the exterior extension slot 123, and an outer cover 228 to cover an outer portion of the exterior extension slot 123. The pivot pin 161 of the upper sash 102 (FIG. 6) is allowed to travel vertically in the area between the inner cover 226 and the outer cover 228.

The exterior jamb liner cover 225 can be fixed to the side jamb or can be removable. To connect the outer cover 228, one or more engagement legs 230, having a low profile and extending from the exterior cover 228, connect with one or more openings 232 in the side jamb 118. To connect the inner cover 226, a connector leg 234, which extends from the lock channel cover 226, securely engages with an opening or slot 236 in the side jamb 118. The exterior jamb liner cover 225 extends from the bottom of the side jamb to just above the area where the upper sash 102 and lower sash 104 meet while in the closed position.

The exterior jamb liner cover 225 can be constructed of a durable, low-maintenance material like vinyl or aluminum to protect the exterior of the window 100 from weathering. Alternatively, the exterior jamb liner cover 225 can be constructed similar to the concealed jamb liner cover 140 having a profile covered with a wood veneer to give the exterior a uniform wood appearance.

Figure 8:
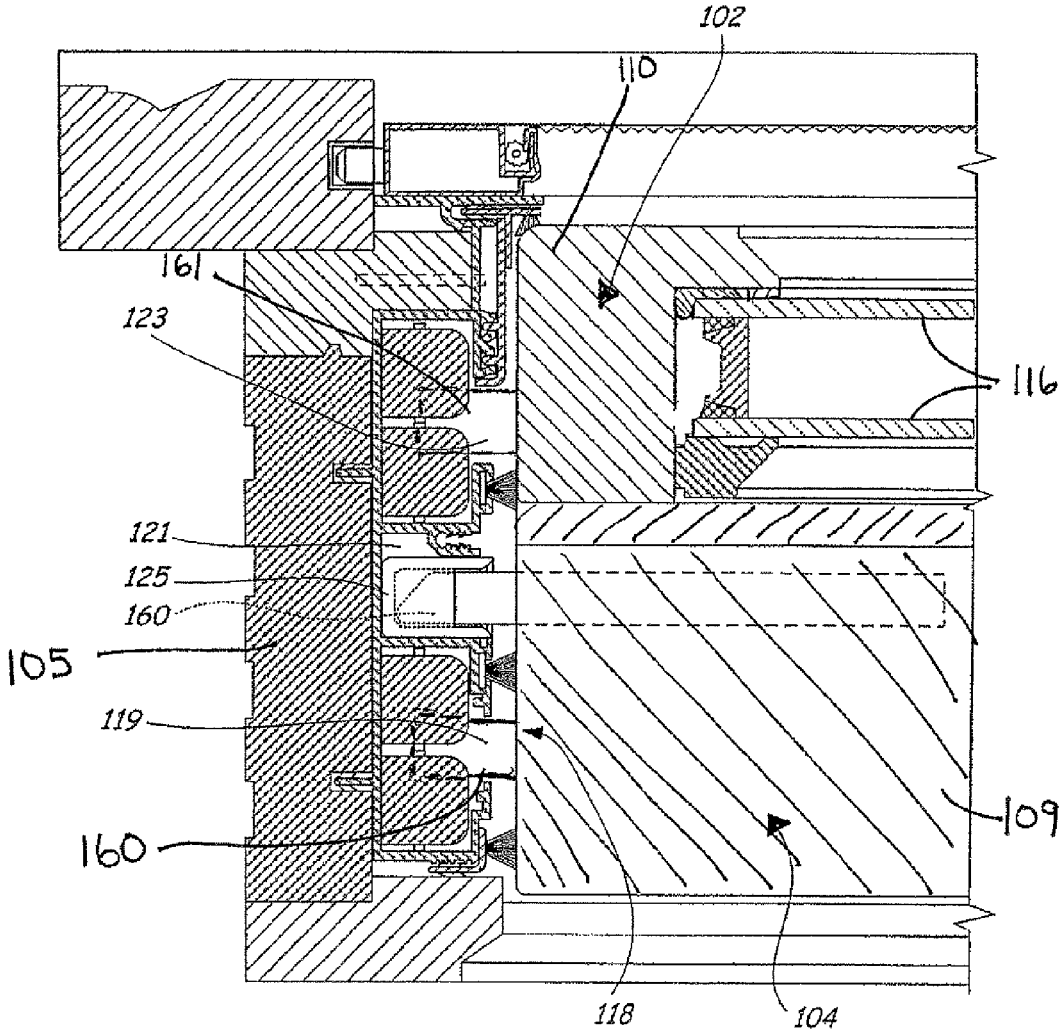
FIG. 8 is a sectional view through the upper and lower sashes of a double-hung window showing the lock pin compartment, as taken along lines C-C in FIG. 1.

FIG. 8 is a sectional view through an upper sash 102 and lower sash 104 where the upper sash 102 and lower sash 104 meet when in the closed position, as taken along line C-C of FIG. 1. A similar design is provided for the second side jamb 120. The first side jamb 118 has an interior extension slot 119, lock slot 121, and exterior extension slot 123 that extend the length of the first side jamb 118. This view shown in FIG. 8 is just below the upper most portion of the top rail 109 of the lower sash 104, so that when the lower sash is closed, there is no need to have the concealed jamb liner cover 140 at this part of the first side jamb 118. The lock pin 158 of the lower sash can be fully extended outwardly at this portion of the side jamb because the lower sash 104 is in the closed position. Lock chamber 125 is affixed in the lock slot 121, such as by one or more suitable fasteners 125*a* (See FIG. 9) into the window frame 105 to receive the full outward extension of the lock pin 158. Lock chamber 125 can be constructed of a metal or strong plastic to create added strength to the lock slot 121. In the event of pressure fluctuations from exterior or interior conditions, the lock chamber 125 prevents the collapse of the lock slot 121 from pressure created from either the upper or lower sash at the interior extension slot 119 or exterior extension slot 123. Further, the lock chamber 125 creates a reinforced area for the lock pin 158 to fully engage when the lock pin 158 is completely extended to secure the lower sash 104.

Figure 9:
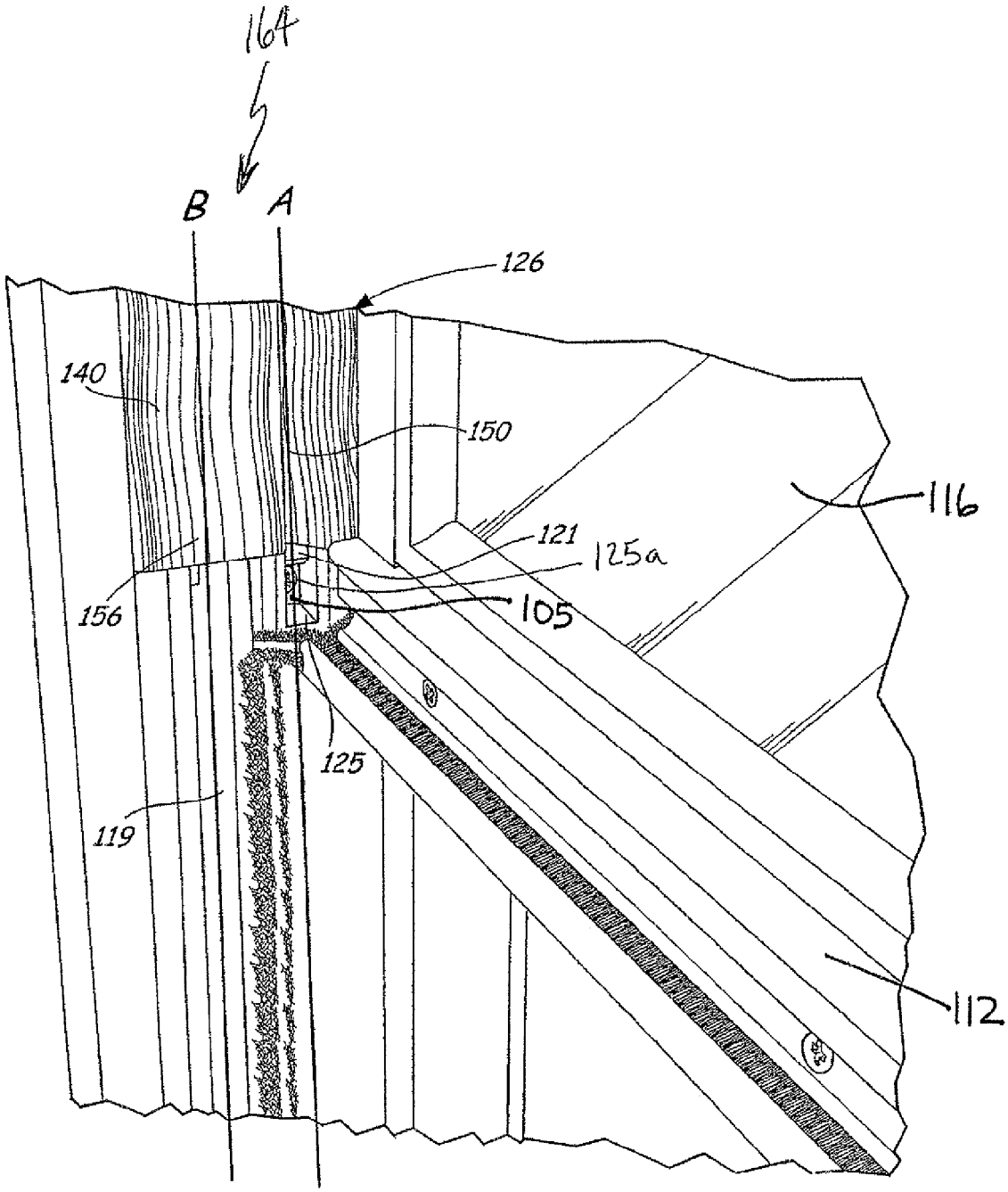
FIG. 9 is a perspective view of a side jamb showing a dual channel system, for allowing sliding movement of the lower sash.

FIG. 9 is a perspective view of an upper first side jamb 126 showing a dual channel system 164 with the lower sash 104 removed for clarity of illustration. A similar design is provided for the second side jamb 120. Each jamb liner cover 140, which extends from the top of the upper sash 102 to just below where the upper sash 102 and lower sash 104 meet, has an indented lock channel 150 for receiving its respective lock pin 158 of the lower sash 104. (See FIG. 6). The lock channel 150 of the concealed jamb liner cover 140 extends inward towards the lock slot 121. Because the lock pin 158 is located at the top rail 108 of the lower sash 104, there is no need to have a lock channel 150 extend below the jamb liner cover 140. Instead, just below the jamb liner cover 140 is the lock chamber 125 for receiving the full extension of the lock pin 158. As the lower sash 104 is moved relative to the side jambs 118 and 120, the side rails 111 of the lower sash 104 slide adjacent to the flat portions 156 of the concealed jamb liner covers 140. The pivot pins 160, which allows the double-hung window to tilt towards the interior, slide vertically in interior extension slot 119. (See FIG. 7). The interior extension slot 119 and the lock channels 150 of the concealed jamb liner cover 140 extend vertically and parallel to one another. Although FIG. 9 shows line A representing lock channel 150 and line B representing interior extension slot 119 extending the entire length of the first side jamb 118, this is only to clearly depict that the lock channel 150 and interior extension slot 119 are not in the same plane.

By placing the lock channel 150 of the concealed jamb liner cover in a plane other than the interior extension slot 119, the lock chamber 125 can be added to the design without interfering with moving parts in the interior extension slot 119 or complicating the manufacturing of the side jamb. The lock chamber 125 adds to the strength of the double hung window from pressure fluctuations from exterior or interior forces.

Figure 10:
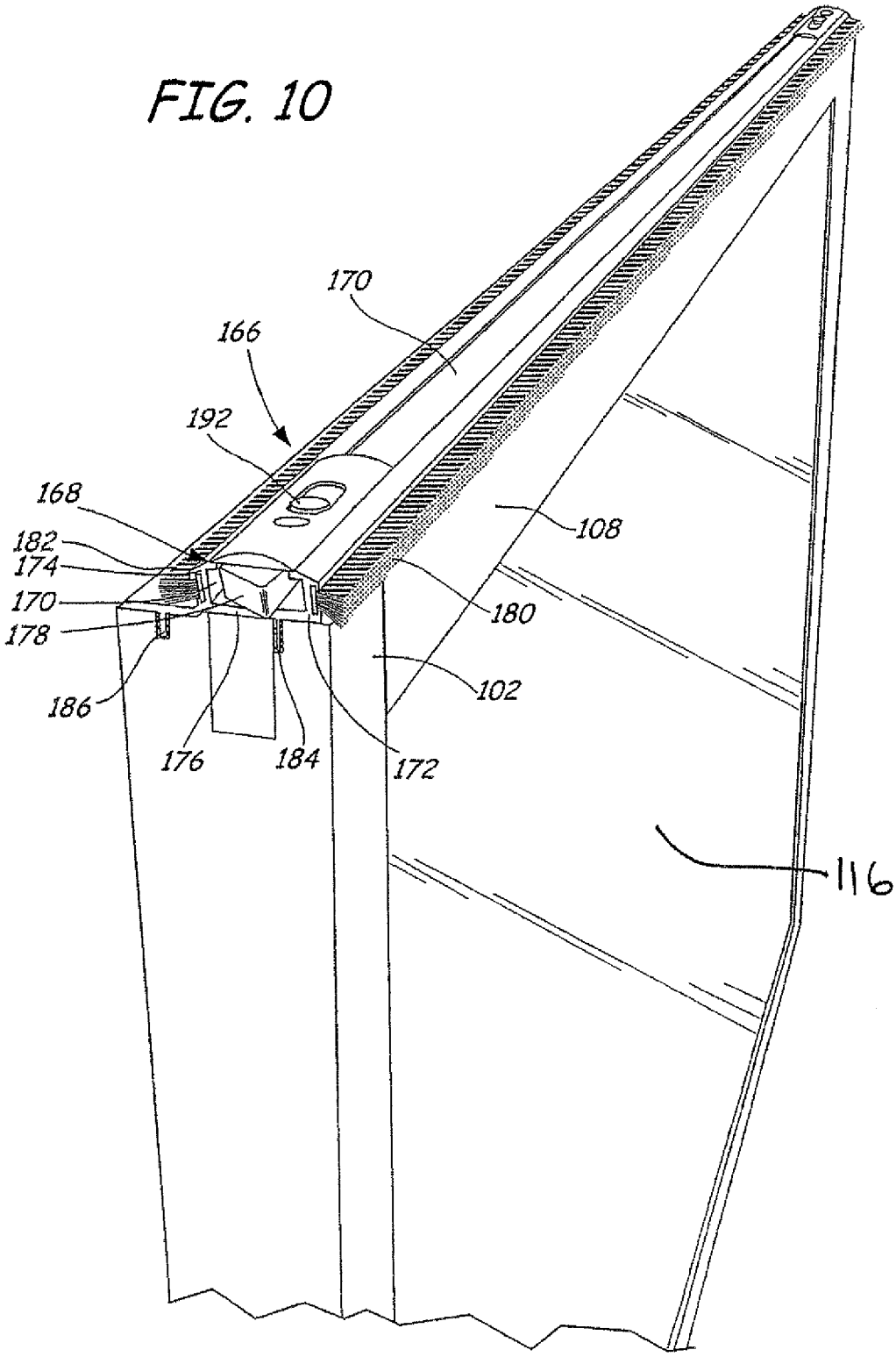
FIG. 10 is a perspective view of an upper side edge of an upper sash lock housing.

FIG. 10 is a perspective side view of the upper end of the upper sash lock housing 166. Like the lower sash 104, the upper sash 102 also has a lock 178 on each side of the upper sash 102 for securing the upper sash 102 within the double-hung window 100, but the lock 178 also can be retracted so that the upper sash 102 can be pivoted towards the interior. To hold the lock 178 is an upper sash lock housing 166 attached to the top rail 108 of the upper sash 102. The upper sash lock housing 166 has a vinyl frame 168 with a first side 172, a second side 174, and a bottom surface 176 for engaging with the top rail 108 of the upper sash 102. The vinyl frame 168 defines a channel 170. Disposed within the channel 170 is the lock 178 at each end. The lock 178 is biased to project laterally from each side of the upper sash 102 but is retractable with a retraction lever 192, which is exposed through the vinyl frame 168. Along the first side 172 of the vinyl frame 168 is a strip of interior weatherstrip 180, and along the second side 174 of the vinyl frame 168 is a strip of exterior weatherstrip 182. (See FIG. 11).

Figure 11:
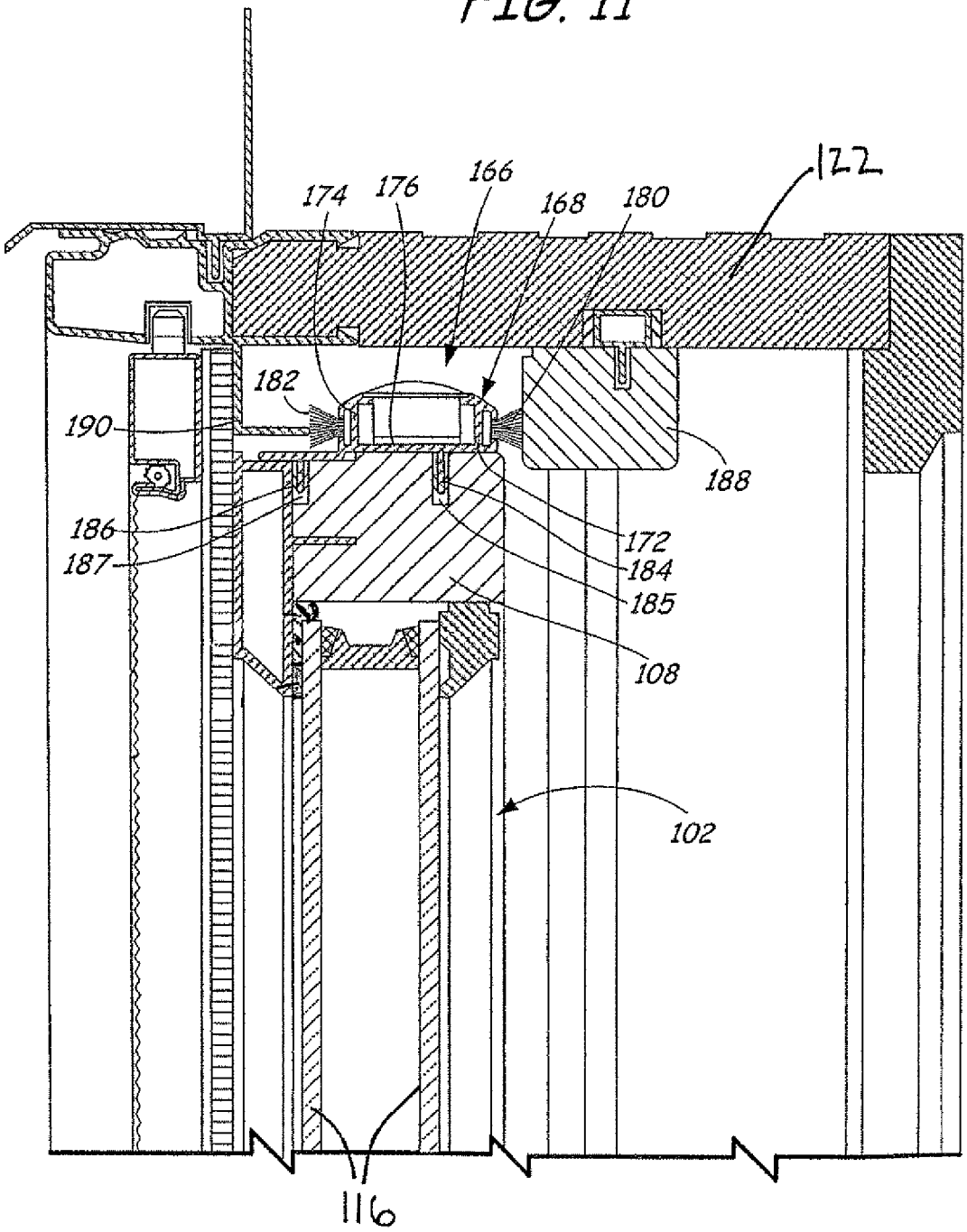
FIG. 11 is a sectional view of the upper sash of a double-hung window showing the upper sash lock housing, as taken along lines D-D in FIG. 1.

FIG. 11 is a sectional view of the upper sash 102 showing the upper sash lock housing 166 taken along line D-D of FIG. 1. First interlock 184 and second interlock 186 connect the upper sash lock housing 166 to the top rail 108 of the upper sash 102. First interlock 184 extends from the bottom surface 176 of the vinyl frame 168 to engage with a slot or opening 185 of the top rail 108. Second interlock 186 extends from the bottom surface 176 of the vinyl frame 168 to engage with a slot or opening 187 of the top rail 108. First and second interlock can be either a single projection or can extend along the entire length of the vinyl frame with a respective slot or opening to receive the interlocks. Alternatively, another mechanical connector or adhesive can be used to connect the upper sash lock housing 166 to the top rail 108 of the upper sash 102.

When the upper sash 102 is closed, as is shown in FIG. 11, interior weatherstrip 180 engages with wooden parting stop 188 and exterior weatherstrip 182 engages with exterior mounting 190 to provide a multiple full width seal for the top of the upper sash 102, thereby achieving improved energy efficiency.

The upper sash lock housing 166 is more easily constructed of a vinyl material, however exposing a vinyl housing to the interior diminishes from the wood appearance of the window. The upper sash lock housing 166 has been constructed with a low profile and when the upper sash 102 is in the closed position, wooden parting stop 188 entirely conceals the upper sash lock housing 166 from sight from the interior of the window 100. Therefore, no vinyl or weatherstrip is visible from the interior and only the wood parting stop 188 and the upper sash 102 are visible. With the wood frame of the upper 102 and lower 104 sashes and the wood parting stop 188 concealing the upper sash lock housing 166, the double-hung window 100 has a uniform wood interior when the window 100 is in the closed position.

The double-hung window of the present invention combines the ability to use plastic, vinyl, wood composite, or metal materials at the side jambs to create an efficient modem window while providing a jamb liner cover that gives the side jambs a uniform wood appearance. Such a design is suitable as a replacement window in older homes and building where a new window is desired having a traditional wood interior.

Additionally, the double-hung window provides an upper sash lock housing constructed of a plastic or vinyl material. The lock housing contains weatherstripping to improve the energy efficiency of the window and houses the lock so the window can be released and titled towards the interior for cleaning. The lock housing has a low profile but also a wood upper parting stop is provided to conceal the lock housing while the window is closed. Additionally, this feature allows for modern features of a window to be provided while preserving the traditional look of a wood window interior. Additional thermal conduction features of a window are disclosed in application Ser. No. 10/760,102, filed Jan. 16, 2004 entitled, "Double-hung Window with Improved Thermal Efficiency," now issued as U.S. Pat. No. 7,296,381 on Nov. 20, 2007, the disclosure of which is hereby incorporated by reference.

Although the present invention has been described with reference to preferred embodiments, workers skilled in the art will recognize that changes may be made in form and detail without departing from the spirit and scope of the invention.

The invention claimed is:

1. A method of installing a jamb liner cover to a window frame of a window assembly, wherein the window frame has a first side jamb and a second side jamb, the method comprising:

aligning a jamb liner cover adjacent to an interior extension slot and a lock pin slot of the first side jamb, wherein the jamb liner cover comprises a first portion having a back side and a substantially flat front side, a channel portion, and an attachment mechanism extending from the back side of the first portion;

inserting the channel portion of the jamb liner cover into the lock pin slot of the first side jamb;

engaging the attachment mechanism of the jamb liner cover with the interior extension slot of the first side jamb to secure to the jamb liner cover to the first side jamb in a manner that covers at least portions of the interior extension slot and the lock pin slot; and slidably retaining a sash to the first side jamb and the second side jamb of the window frame, the sash comprising a lock pin that is extendable into the lock pin slot of the first side jamb.

2. The method of claim 1, and further comprising extending the lock pin of the sash into the channel portion of the jamb liner cover in a manner that allows slidable movement of the sash relative to the window frame and jamb liner cover engaged thereto.

3. The method of claim 1 wherein the window assembly is installed on an exterior wall of a building, such that the window assembly has an exterior side facing an outside of the building and an interior side facing an inside of the building, and further wherein the jamb liner cover is secured to the interior side of the window assembly.

4. The method of claim 1, wherein engaging the attachment mechanism of the jamb liner cover with the interior extension slot of the first side jamb comprises snap fitting the attachment mechanism to the extension slot.

* * * * *

UNITED STATES PATENT AND TRADEMARK OFFICE

CERTIFICATE OF CORRECTION

PATENT NO. : 8,429,856 B1
APPLICATION NO. : 13/486447
DATED : April 30, 2013
INVENTOR(S) : McCabe et al.

It is certified that error appears in the above-identified patent and that said Letters Patent is hereby corrected as shown below:

In the Claims:

In Column 9, Claim 1:

In Line 23: delete “secure to the” and insert -- secure the --

Signed and Sealed this
Twenty-second Day of April, 2014

Michelle K. Lee

Michelle K. Lee
*Deputy Director of the United States Patent and Trademark Office*